US005361415A

United States Patent [19]

Deering et al.

[11] Patent Number: 5,361,415

[45] Date of Patent: Nov. 8, 1994

[54] CHILD'S MITTEN

[76] Inventors: Bradley E. Deering; Diane L. Deering, both of 20795 Linwood Rd., Deephaven, Minn. 55331

[21] Appl. No.: 998,681

[22] Filed: Dec. 30, 1992

[51] Int. Cl.[5] ..... A41D 19/01

[52] U.S. Cl. ..... 2/158; 2/160; 2/161.1; 2/167

[58] Field of Search ..... 2/59, 158, 16, 159, 2/91, 161.1, 161.2, 161.3, 161.4, 161.5, 161.6, 161.8, 164, 167, 168, 169, 160

[56] References Cited

U.S. PATENT DOCUMENTS

| | | | |
|---|---|---|---|
| 338,790 | 3/1886 | Slack | 2/158 X |
| 532,880 | 1/1895 | Hunicke | 2/158 |
| 1,280,421 | 10/1918 | Diem | 2/158 |
| 1,774,093 | 8/1930 | Gillian | 2/161 R |
| 2,937,378 | 5/1960 | Mackay et al. | 2/158 |
| 4,662,006 | 5/1987 | Ross, Jr. | 2/158 |

FOREIGN PATENT DOCUMENTS

| | | | |
|---|---|---|---|
| 1125136 | 10/1956 | France | 2/16 |
| 277696 | 1/1928 | United Kingdom | 2/59 |
| 388837 | 3/1933 | United Kingdom | 2/158 |

*Primary Examiner*—Jeanette E. Chapman
*Attorney, Agent, or Firm*—Moore & Hansen

[57] ABSTRACT

A child's mitten comprises an insulation member overcovering the hand, including the thumb and fingers. A water-resistant shell covers the insulation member and includes a flared arm portion configured to extend up the wearer's lower arm and over the elbow. An elastic member in a cuff at the upper end of the arm portion holds the mitten above the elbow. An additional elastic member may be placed within the wrist portion to compress it about the wearer's wrist, the insulation member abutting or overcovering the wearer's jacket or coat cuff to maintain a continuous insulative layer over the wearer's wrist. In another feature of the invention, a universal thumb enclosure has a base width equal to the base width of the finger enclosure, or nearly so, enabling its use on either of the wearer's left or right hand.

8 Claims, 3 Drawing Sheets

CHILD'S MITTEN

BACKGROUND OF THE INVENTION

This invention relates generally to insulative wearing apparel. More particularly, this invention pertains to insulated mittens for children.

A variety of mitten constructions for children has evolved over many years. However, mittens of the prior art have numerous well-known drawbacks.

Some mittens are not firmly retained on the wearer's hands, tending to slip or fall off during play. To overcome this disadvantage, some constructions use a tightly fitting mitten held on by friction. This type of construction results in a reduced insulative effect and reduced freedom of movement in the region of compression. Some mittens may be so tightly fitted that blood circulation in the fingers or hand may be restricted. In addition, tightly fitting mittens tend to be difficult to mount on a young child's hand, either by the child itself or by another person.

Many of the children's mittens currently marketed have no means for closing the space between coat and mitten at the wrist. As a result, the wrist is subject to cold temperatures as well as to the entrance of snow. Some mitten constructions seek to overcome the problem by detachable fastening means between the mitten and the arm cuff of the coat. Thus, buttons, zippers, matching VELCRO strips, and the like are commonly used. Such constructions require modification of each outer upper garment which the child may wear in order to be fully effective. A common "makeshift" remedy is to join the mittens to the coat sleeves with safety pins after the child's hands are inserted. Such a solution is undesirable from both aesthetic and utility standpoints.

Young children often have trouble distinguishing between the left and right mittens, and attempt to mount a mitten on the wrong hand.

A new mitten construction is needed to overcome these disadvantages and provide for easy mounting and dismounting, yet with continuous protection of the wrist area.

BRIEF SUMMARY OF THE INVENTION

The primary objective of this invention is to provide a child's insulated mitten for outdoor use in a cold climate.

Another objective of the invention is to provide a mitten in which the open space between the mitten and the overcoat sleeve in the wrist area is eliminated, thus avoiding direct exposure of the wrist area to the elements.

A related objective is to provide a mitten whose construction deters the entry of snow and the like into the overcoat sleeve and/or mitten in the wrist area, i.e. a mitten which keeps the wrist area dry.

A further objective is to provide a mitten which is easy to mount on and remove from a child's hand by another person.

An additional objective is to provide a mitten which may be easily mounted and removed by the wearer.

Another objective of the invention is to provide a mitten which is firmly held onto a child's arm and hand during normal play activities without the need to tie strings or use retaining clips, safety pins and the like.

An additional objective is to provide means for shielding a child's winter coat sleeves from dirt.

Another objective of the invention is to provide a mitten having a separate thumb configured so that the left and fight mittens of the pair are interchangeable.

A further objective of the invention is to provide a mitten which is easily formed of available sturdy materials which will withstand rough use.

The invention is a child's mitten comprising an outer fabric shell and insulation internally attached thereto. An internal slide liner overcovers the interior surface of the insulation for contact with the hand. The slide liner is foraged of a relatively smooth material such as brushed stretch nylon material or the like. The outer shell includes a flared arm portion or gauntlet which slips over the lower arm of a jacket or other outer garment, and extends upwardly to a position above the elbow. The cuff of the arm portion has elastic means for holding it above the elbow, preventing accidental removal of the mitten during play. The layer of insulative material within the mitten is positioned to abut the cuff of the child's jacket, wherein the mitten of the invention ensures uninterrupted insulation value at the otherwise open wrist area. Snow, mud, water and cold air are prevented from entering the hand area of the mitten and the lower arm of the wearer's coat or jacket.

In a further aspect of the invention, the thumb of the mitten is widened to span a major portion of the mitten width, enabling the mitten to be worn comfortably on either the right or leff hand. Thus, the right and left mittens may be identical in construction, and completely interchangeable.

While the mittens are particularly useful for children up to about 10 years of age, they may also be adapted in larger sizes for older children, and indeed, even adults.

These and other objects, advantages and features of the invention will be readily understood by a reading of the following description in conjunction with the accompanying figures of the drawings wherein like reference numerals have been applied to designate like elements throughout the several views.

DESCRIPTION OF THE PREFERRED EMBODIMENTS

Figure 1:
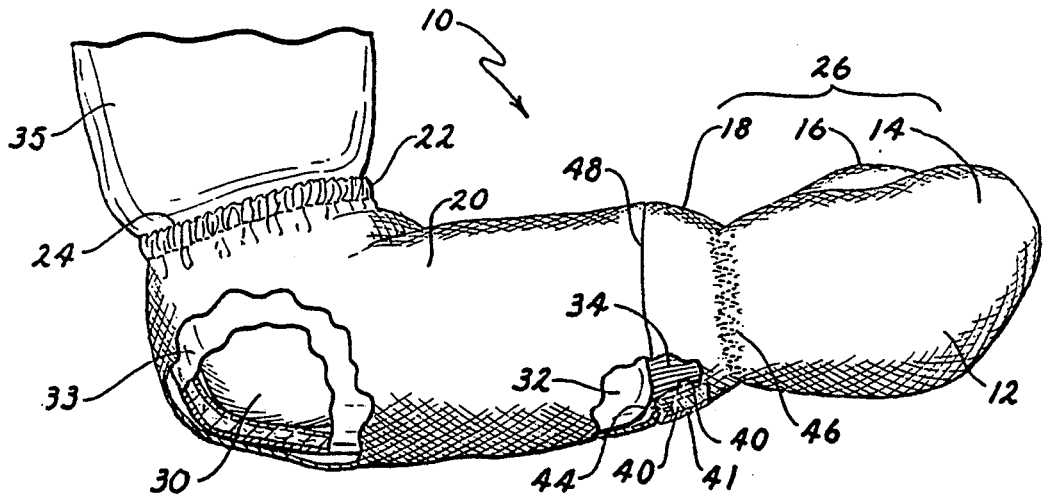
FIG. 1 is a partially cutaway, partially sectioned side view of a mitten of the invention mounted on the arm of a child.

With reference to the drawings, and particularly to FIG. 1, a child's mitten 10 of the invention is depicted having an outer shell 12 typically formed of rip-stop nylon or other waterproof or water repellant closely woven fabric material well adapted to withstand abuse. The outer shell 12 may be viewed as having a finger enclosure 14 to enclose non-thumb fingers, thumb enclosure 16, wrist portion 18 and a flared arm portion or gauntlet 20 with a cuff 22 surrounding the open end 24. The finger enclosure 14, thumb enclosure 16 and wrist portion 18 together form a hand enclosure 26 which is joined to the flared arm portion 20.

For purposes of this description, the finger enclosure 14 is considered to begin at the base 21 of the thumb enclosure 16. The base is approximated by a fold line 23 separating the finger enclosure 14 and thumb enclosure 16. The width of the finger enclosure 14 at this location (see base dimension 62 of FIG. 3) is considered to be the corresponding mitten width and may be slightly less or greater than the actual maximum width of the mitten 10.

The cuff 22 of the arm portion 20 is preferably folded over and gathered about an elastic member 28 (see FIG. 4) to hold the cuff above the wearer's elbow 30. As shown, the flared arm portion 20 overcovers the lower arm 32 and elbow 33 of the wearer's outer garment, typically a jacket or coat 35. The flared arm portion 20 is loose and bloused enough to readily slip over the sleeve of a jacket or coat. An exemplary jacket is shown with a lower arm 32 having a soft wrist-hugging arm cuff 34. An insulation member or layer 40 of the mitten 10 is shown as a layer within the hand enclosure 26 of the shell 12, with a soft liner 44 covering the inside surface 42 of the insulation layer 40. The insulation member 40 is located within the hand enclosure 26 to abut or overcover the arm cuff 34 so that there exists insulative material continuously between arm and hand of the wearer. In FIG. 1, the insulative layer 40 overlaps the arm cuff 34 and abuts the lower arm 32 of the jacket 35.

The insulation layer 40 may be formed of a woven fabric of natural or synthetic fibers or a blend thereof. The insulation may comprise down, DACRON, or other lofting fiber material. A preferred insulation material is THINSULATE, a product of 3M Corporation.

The hand enclosure 26 and flared arm portion 20 are shown as being joined along seam 48 which encircles the wrist or lower arm area of the wearer.

Preferably, the wrist portion 18 of the shell 12 covers another elastic band member 36 (see FIG. 4) which encircles the inner surface 38 of the wrist portion. As shown, the elastic member 36 is joined to the inside surface 38 of gathered shell 12 by zig-zag sewing 46.

The insulative layer 40 is positioned as a lining within the finger enclosure 14, thumb enclosure 16 and wrist portion 18. The insulation layer 40 extends up the wrist a sufficient distance to a terminus 41 to at least abut the cuff 34 of the outer garment worn by the child, or to overlap it as shown in FIG. 1.

Figure 2:
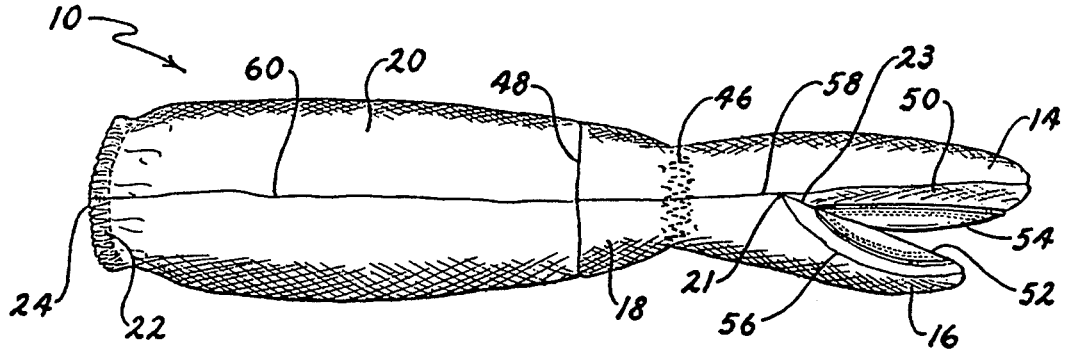
FIG. 2 is an edge view of a mitten of the invention.

Turning now to FIG. 2, facing portions of the thumb and finger enclosures 16, 14 are typically formed of a single piece 50 of material. The piece 50 is joined to the rest of the shell 12 along thumb seam 56 and bisecting seam 58. The flared arm portion 20 is formed of one or two pieces of fabric which are joined along bisecting seam 60. Conventional glove making techniques are employed, i.e. cutting the components to the required size and shape, and sewing or otherwise fastening them together. Preferably, the shell 12 and insulation layer 40 are assembled and sewn in the inverted position to provide smooth outer seam joints. In addition, it is preferred to join the liner 44 to the shell 12 at the seam 58 near the tips of the finger enclosure 14 and thumb enclosure 16, so that the liner will remain in the mitten when a hand is pulled from the mitten.

As shown, opposed grasping portions 52, 54 of the thumb and finger enclosures may include a pad or pads of abrasion and water resistant material such as leather, simulated leather, thin plastic, plastic coated fabric, and the like. The surface of the material of portions 52, 54 may be textured to permit a wearer to easily grip objects.

The finger enclosure 14 is sized to receive and hold the four non-thumb fingers 42 of the child, preferably without separate finger stalls.

Figure 3:
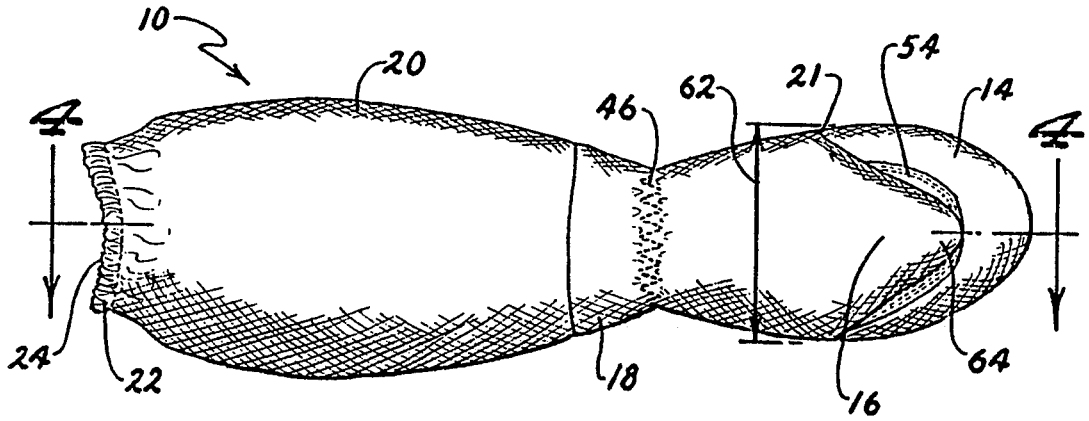
FIG. 3 is a bottom view of the mitten of FIG. 2.

As depicted in a preferred embodiment of FIG. 3, a "universal" thumb enclosure or "unithumb" 16 is formed having a base dimension 62 equal to the width of the flattened mitten 10 at that point. This enables the mitten 10 to be worn on either hand, i.e. left or right hand. Manufacture is also simplified by eliminating differences in the thumb design. To enable comfortable use on either hand, the base dimension 62 should be at least 0.8 times the mitten width at that point. The thumb enclosure 16 may taper sharply to its upper end 64, however, because of the inherent "give" in the fabric of the thumb enclosure 16 which allows it to bend in any direction.

Figure 4:
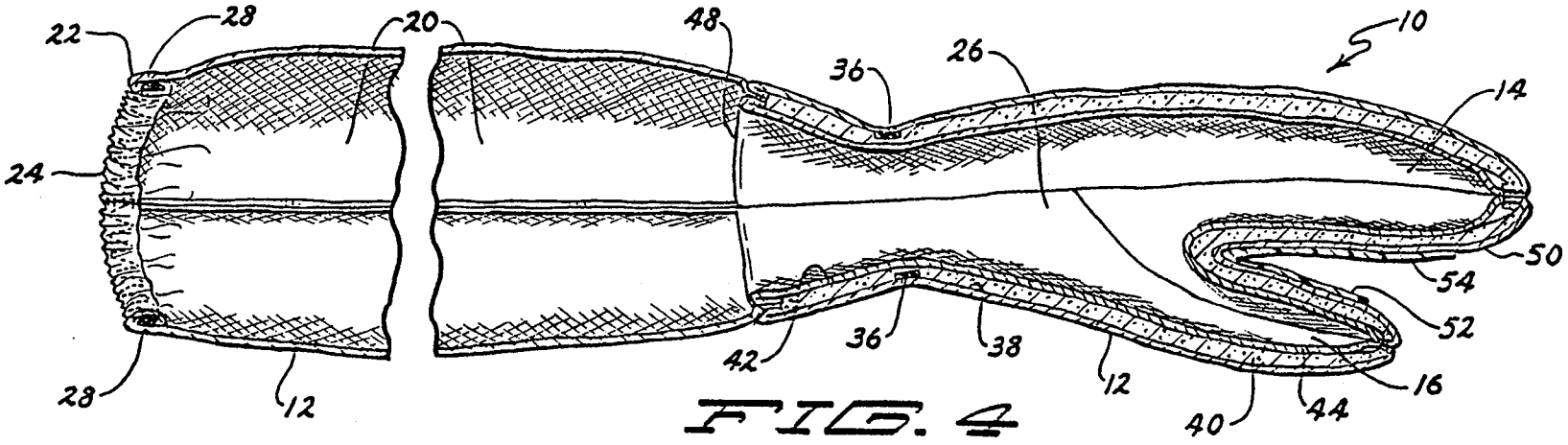
FIG. 4 is a longitudinal sectional partial view of a mitten of the invention, taken along line 4—4 of FIG. 3.

FIG. 4 is a cross-sectional view illustrating the various components of the mitten 10. The hand enclosure 26 includes the finger enclosure 14 and thumb enclosure 16, and it comprises an outer shell 12 continuous with the fabric 50 of the grasping portion, an insulation layer 40 and a liner 44 on the inner surface of the insulation layer.

The elastic members 28 and 36 are preferably continuous flat bands of elastic material. The elastic band 28 is enclosed in the folded and sewn cuff 22. The elastic band 36 is sewn to the underside of shell 12 or between the shell 12 and the insulation layer 40.

The hand enclosure 26 is shown in FIG. 4 as attached to the flared arm portion 20 by sewing. The edge of the shell 12 and liner 44 are shown as folded over the intervening flared arm portion 20 and sewn along seam 48 encircling the mitten 10, to enclose the insulation layer 40.

Figure 5:
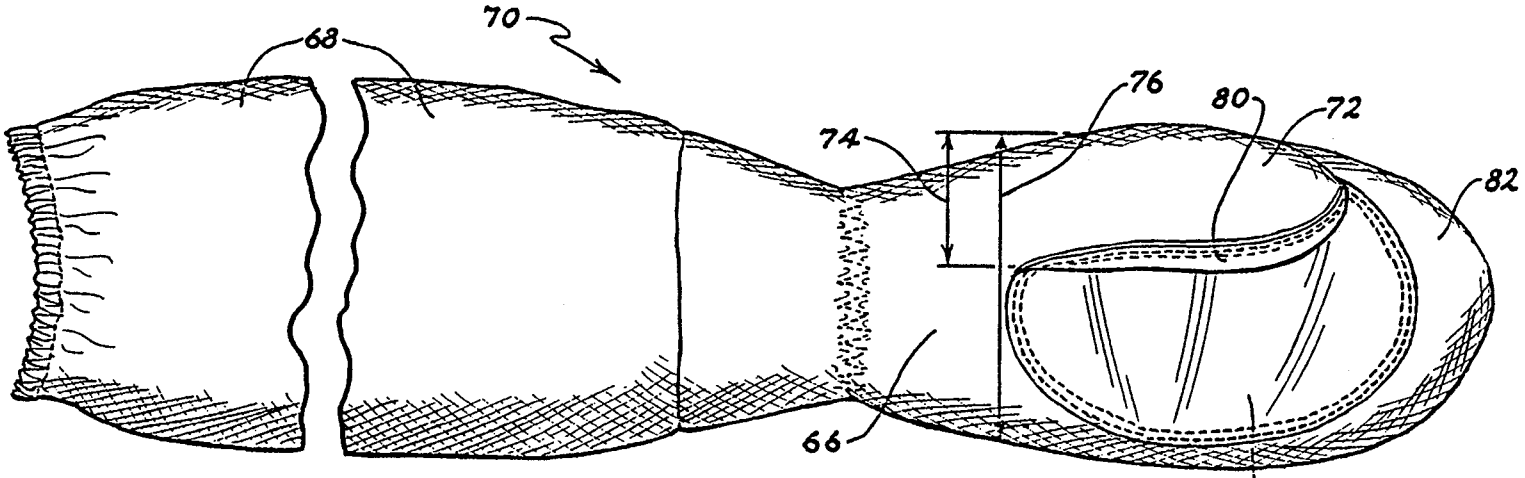
FIG. 5 is a bottom view of a mitten in accordance with another embodiment of the invention.

In FIG. 5, another mitten version 70 is shown which has a hand enclosure 66 and a flared arm portion 68. The thumb enclosure 72 is designated for the right or left hand only. The mitten 70 is shown with a left hand thumb enclosure 72 whose base width 74 spans less than about 60 percent of the corresponding mitten width 76 at that location. The mitten 70 is shown as having a outer finger pad 78 and an outer thumb pad 80 on generally opposed surfaces of the finger enclosure 82 and thumb enclosure 72. These pads may be formed from a single piece of leather, imitation leather, flexible plastic layer or other material which is water resistant or water proof, and will withstand the gripping forces of the wearer. The embodiment of FIG. 5 of the invention is particularly useful for older children who have no problem in distinguishing the left and right hand mittens.

Figure 6:
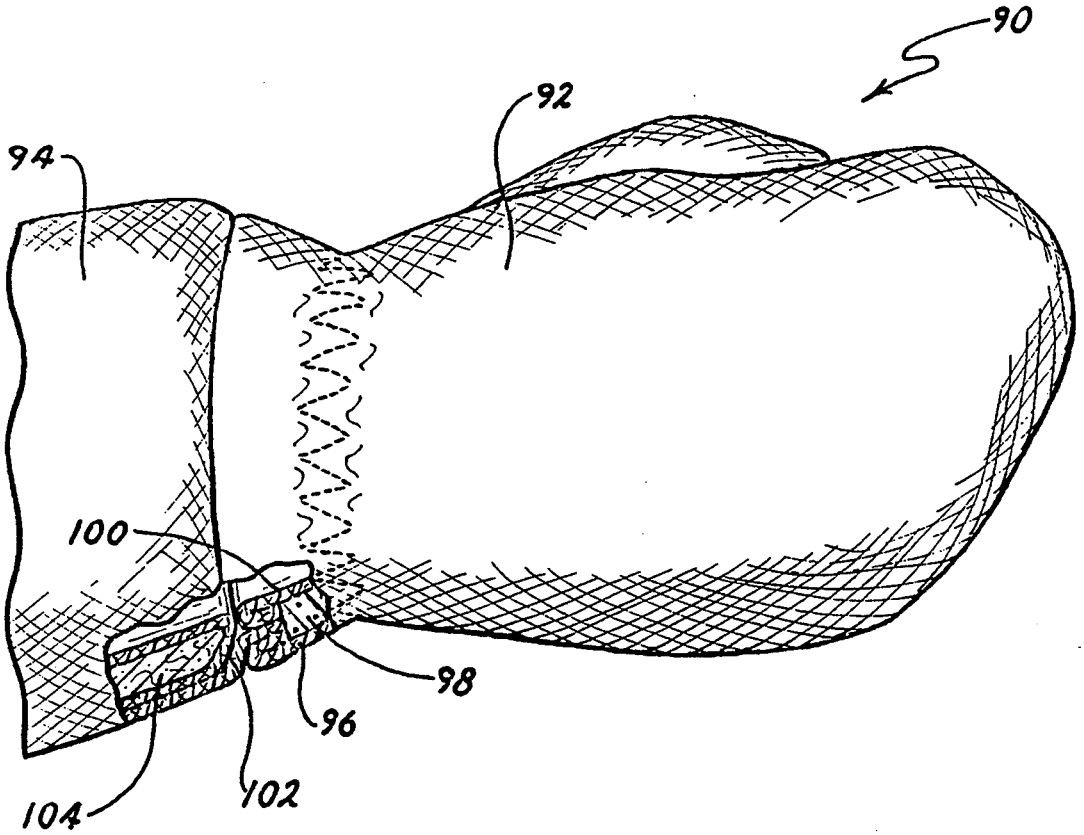
FIG. 6 is a partially cutaway, partially sectional side view of another version of the invention mounted on the arm of a child.

In FIG. 6, another version of the invention is shown as mitten 90, and comprises a hand enclosure 92 and a flared and bloused arm portion 94. The hand enclosure 92 includes an outer shell 96 lined with an insulation layer 98 and a liner 100. The arm portion 94 comprises an extension of shell 96.

In this embodiment, the terminus 102 of insulation layer 98 and liner 100 is configured to abut the jacket sleeve 104 overcovered by the flared arm portion 94. In other respects, the mitten 90 is like mittens 10 or 70, already described.

The mitten construction of the invention results in a child's mitten which is worn over the elbow outside of the child's winter clothing. Unlike conventional mittens, the wrist portion of the wearer is not open to the weather, but is covered. The insulative value of the wearer's jacket is extended by the mitten to cover the fingers and thumb, without a break. The opening into the mitten is located above the elbow, and the opening is closed by an elastic member which hugs the arm of the jacket. As a result, the child may play in snow, rain, etc. while avoiding the entry of same into the wrist area. The child's wrist stays warm and dry.

When used with small children, the mitten is easy to put on, and stays on until specifically removed. The use of clips, straps, or other attachment means to keep the mitten on is avoided. Even small children can quickly learn to put on and take off the mittens.

The embodiment of the invention using a wide thumb enclosure avoids the necessity for the child to differentiate between the left and right mittens. In addition the wide thumb enclosure permits thumb movement within the enclosure, and does not compress the insulation layer. Insulation compression leads to a loss of thermal insulative value.

The mitten of the invention is easily made from conventional fabrics and materials. Available materials such as THINSULATE which provide a very high insulative value in a thin layer, are readily incorporated into the mitten.

It is anticipated that various changes and modifications may be made in the construction, arrangement and method of construction of the child's mitten disclosed herein without departing from the spirit and scope of the invention as defined in the following claims:

What is claimed is:

1. A child's mitten for covering the hand, wrist portion, lower arm and elbow of a child, comprising:

a thermal insulation member, comprising a finger enclosure and a thumb enclosure joined thereto and defining together a hand portion for mounting on a child's hand, said insulation member extending to cover the wearer's hand to the wrist portion thereof; an abrasion resistant pad joined to a shell covering said mitten on normally opposed outer facing portions of said shell of said finger enclosure and said thumb enclosure;

said shell covering the thermal insulation member, said shell including an arm portion comprising a single layer of loose, waterproof or water repellant fabric configured to cover a lower arm portion of an outer garment worn by the child and extending to a cuff end configured to be worn above the wearer's elbow;

an elastic member encircling and joined in said cuff end for compressing the cuff end about the child's arm above the elbow to retain said cuff end above the elbow; and an elastic band mounted between said shell and said insulation member to compress the insulation member about the child's wrist;

said insulation member has an inner surface, said child's mitten further comprising a liner overcovering the inner surface.

2. The child's mitten of claim 1, wherein the pad is of a material from the group consisting of leather, simulated leather, thin plastic, and plastic coated fabric.

3. The child's mitten of claim 1, wherein the base width of said thumb enclosure substantially corresponds to the flattened width of said mitten whereby the mitten may be worn on either hand of the child.

4. The child's mitten of claim 1, wherein said thumb enclosure has a base width at least 0.8 of the mitten width.

5. The child's mitten of claim 1, wherein the shell is a material from the group consisting of rip-stop nylon, plastic coated fabric, and leather.

6. The child's mitten of claim 1, wherein the hand portion and the arm portion are separately formed and joined along a wrist-encircling seam.

7. The child's mitten of claim 1, wherein the base width of the thumb enclosure is less than 60 percent of the corresponding width of the mitten, said thumb enclosure offset to one side for mounting on a single one of the left hand thumb and the right hand thumb of the child.

8. A mitten to enclose a child's hand, wrist portion, lower arm and elbow, comprising:

a hand enclosure with thermal insulation means for enclosing a child's hand to the wrist, said hand enclosure including a finger enclosure and an opposed universal thumb enclosure aligned therewith, said thumb enclosure having a base width along a fold line juncture with said finger enclosure equal to at least 80 percent of the mitten width at that location and configured to interchangeably enclose a left hand thumb or a right hand thumb;

an abrasion resistant pad joined to a shell covering said mitten on normally opposed outer facing portions of said shell and of said finger enclosure and said thumb enclosure;

said shell covering the hand enclosure, said shell including an arm portion comprising a single layer of loose, waterproof or water repellant fabric and configured to cover a lower arm portion of a long sleeved outer garment worn by the child and extending to a cuff end configured to be worn above the wearer's elbow;

an elastic member encircling and joined in said cuff end for compressing the cuff end about the child's arm above the elbow to retain said cuff end above the elbow; and an elastic band mounted between said shell and said insulation member to compress the insulation member about the child's wrist;

said insulation layer has an inner surface, said child's mitten further comprising a liner overcovering the inner surface.

* * * * *

UNITED STATES PATENT AND TRADEMARK OFFICE

CERTIFICATE OF CORRECTION

PATENT NO. : 5,361,415

DATED : November 8, 1994

INVENTOR(S) : Deering et al.

It is certified that error appears in the above-indentified patent and that said Letters Patent is hereby corrected as shown below:

Column 2, line 11, delete "foraged," and replace with --formed--.

Signed and Sealed this

Twenty-first Day of March, 1995

*Attest:*

Bruce Lehman

BRUCE LEHMAN

*Attesting Officer*

*Commissioner of Patents and Trademarks*